US008418703B2

(12) United States Patent
Schessl et al.

(10) Patent No.: US 8,418,703 B2
(45) Date of Patent: Apr. 16, 2013

(54) DEVICE FOR FITTING AN OBJECT IN A DISHWASHER

(75) Inventors: Bernd Schessl, Dillingen/Donau (DE); Rainer Schütz, Neresheim (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1882 days.

(21) Appl. No.: 10/589,053

(22) PCT Filed: Feb. 11, 2005

(86) PCT No.: PCT/EP2005/050610

§ 371 (c)(1),
(2), (4) Date: Apr. 4, 2007

(87) PCT Pub. No.: WO2005/077246

PCT Pub. Date: Aug. 25, 2005

(65) Prior Publication Data

US 2007/0277857 A1 Dec. 6, 2007

(30) Foreign Application Priority Data

Feb. 13, 2004 (DE) ..... 10 2004 007 245
Apr. 21, 2004 (DE) ..... 10 2004 019 344

(51) Int. Cl.
*B08B 3/12* (2006.01)
*B08B 6/00* (2006.01)

(52) U.S. Cl.
USPC ..... 134/201; 134/56 D; 134/57 D

(58) Field of Classification Search ..... None
See application file for complete search history.

(56) References Cited

U.S. PATENT DOCUMENTS

| | | | | |
|---|---|---|---|---|
| 3,289,854 | A * | 12/1966 | Kauffman | 211/41.9 |
| 4,927,033 | A * | 5/1990 | Patera et al. | 211/41.9 |
| 5,580,025 | A | 12/1996 | Cross | |
| 5,918,749 | A * | 7/1999 | Pille et al. | 211/41.9 |
| 6,156,275 | A | 12/2000 | Dumitrescu et al. | |
| 6,827,225 | B2 * | 12/2004 | Miilu et al. | 211/41.9 |
| 2003/0205260 | A1 | 11/2003 | McConnell et al. | |

FOREIGN PATENT DOCUMENTS

| | | |
|---|---|---|
| DE | 297 09 901 U1 | 8/1997 |
| DE | 298 22 086 U1 | 6/1999 |

OTHER PUBLICATIONS

International Search Report PCT/EP2005/050610.

* cited by examiner

*Primary Examiner* — Michael Barr
*Assistant Examiner* — Jason Ko
(74) *Attorney, Agent, or Firm* — James E. Howard; Andre Pallapies

(57) ABSTRACT

A device for fitting an object in a dishwasher is provided. The device can be easily integrated as complementary equipment in a large number of the dishwasher racks and provides the user with the possibility of rapidly filling objects and even fitting objects which are non cylindrical in shape. The fixing device comprises a first section designed to be coupled with the rack of a dishwasher, and a second section that extends substantially vertically forming a curve, the first section being designed to be non rotating and to be coupled with a vertical element of the dishwasher rack.

14 Claims, 1 Drawing Sheet

DEVICE FOR FITTING AN OBJECT IN A DISHWASHER

The invention relates to a device for fitting an object in a dishwasher, comprising a first section designed to be coupled to the crockery basket of the dishwasher and a second section which extends substantially vertically forming a curve.

A device for fixing an object in a dishwasher is known from U.S. Pat. No. 4,927,033 which comprises a first section for fixing to a dish basket comprising two hook-shaped connecting means which are connected to a horizontal basket element of the dish basket by means of a positive connection. Furthermore, the fixing device has a second section consisting of a curvilinear substantially vertically extending retaining loop, both ends whereof are guided together in the first section.

At least three horizontal basket elements are required for the arrangement of the known fixing device, which elements must have a predefined spacing with respect to one another since the degree of freedom of the fixing device is determined by the position of these horizontal basket elements. For this purpose the lower horizontal basket element is embodied as a counter-bearing against any pivoting of the fixing device, the middle basket element is embodied for securing the fixing device and the upper basket element is embodied as a stop means for retaining the object.

It is also possible for the known fixing device to be arranged between vertical basket elements but there is then no possibility of a stop means so that reliable fixing of the object to be retained cannot be ensured. Since the arrangement of horizontal basket elements for lateral limitation of a crockery basket has the disadvantage that objects such as cooking spoons, ladles or similar can fall out laterally, the use of vertical basket elements in the side regions of a crockery basket has largely prevailed.

However, when using vertical basket elements, the known fixing device has the disadvantage that it is not directly connected to a vertical basket element and thus no specific stop means are provided for objects, especially hollow containers. Another disadvantage is that the known fixing device cannot be retrofitted in existing crockery baskets with a plurality of vertical basket elements and only a few horizontal elements.

It is thus the object of the invention to provide a device for fitting an object in a dishwasher which is firstly capable of being easily integrated as complementary equipment in a large number of crockery baskets and which secondly can rapidly be filled with objects by the user and can even fit objects having non-cylindrical shapes or light weight.

The object is achieved by the fixing device according to the invention having the features according to claim 1. Advantageous further developments are characterised in the dependent claims.

The fixing device according to the invention for an object in a dishwasher consists of a first section which can be coupled to a crockery basket of the dishwasher and a second section which extends substantially vertically forming a curve, the first section being designed as substantially non-rotating and capable of being coupled to a vertical element of the crockery basket.

The second section can advantageously be deformed manually and is embodied as a retaining clip which is suitable for being clipped in a hollow vessel, for example, a glass or a vase, to rest against the inner wall of the vessel in a springy manner.

Advantageously the first section provides at least one receiving area suitable for fixing to a vertical basket element and is embodied as a connecting region.

This first section is appropriately connected in one piece to the second section and can be connected to the vertical basket elements of the crockery basket by means of so-called snap connections.

The basket elements are conventionally formed from plastic-coated (preferably PA) metal wires which have a specific diameter so that they can be retrofitted for a plurality of crockery baskets.

The second section which is appropriately embodied as an S-shaped retaining clip is advantageously interrupted along its vertical axis in such a manner that a vertical basket element can be guided through this interrupted section of the S-shaped retaining slip so that an object to be fixed, for example, a hollow vessel comes to lie along the vertical basket element and experiences a certain pressing force by means of the S-shaped retaining clip which presses it against the vertical basket element aligned centrally to the retaining clip.

A retaining region is advantageously provided on the first section, its alignment pointing away from the vertical basket element in the direction of the second section embodied as a retaining clip. The retaining region consists of a projecting overhang comprising an upper side which has a sloping surface and a lower side which forms a substantially horizontal surface. Whilst the sloping surface of the upper side facilitates insertion of objects, the lower side with its spring-back end serves to prevent undesirable loosening of the fixing. In particular, light objects such as yoghurt cups or plastic vessels can be reliably fixed with one edge in the retaining region so that they are not dislodged from the fixing device, for example, even in the presence of stronger spray jets for example.

The fixing device according to the invention has the advantage that an object to be fixed is pushed with its opening downwards over the second section and in the crossing point area between the second section embodied as a retaining clip and the vertical basket element, contacts both the vertical basket element and the second section embodied as a retaining clip and can thus obtain good guidance along the vertical basket element.

A further downward movement of the object to be fixed results in bending of the second section embodied as a retaining clip which is thus exposed to a certain pre-stress and ultimately results in a large-area contact surface between the object to be fixed and the crockery basket.

As a result of the cooperation of the vertical basket element with the second section embodied as a retaining clip, it is possible for the user to easily insert objects, for example, hollow vessels since the angle subtended between the second section embodied as a retaining clip and the vertical basket element serves as an insertion aid which makes it possible for the user to easily fix the vessel to be retained with its opening downwards using only one hand.

The fixing device according to the invention has the advantage that this can be fitted subsequently to a plurality of conventional crockery baskets since only one vertical basket element is required for its fixing. If for example, very small hollow containers such as Schnapps glasses are to be cleaned, a plurality of fixing devices according to the invention can even be attached one above the other. As a result of the snap connections, these devices can be retrofitted, exchanged and also briefly removed for the duration of a wash.

In another preferred embodiment of the present invention, the fixing device according to the invention is detachably arranged on a cutlery basket or non-detachably arranged on any area of a crockery basket or non-detachably moulded onto the cutlery basket during the production process. The effects and advantages of these embodiments correspond to the embodiment explained in detail hereinafter.

A preferred embodiment of the present invention is explained in detail hereinafter with reference to the drawings. In the figures.

Figure 1:
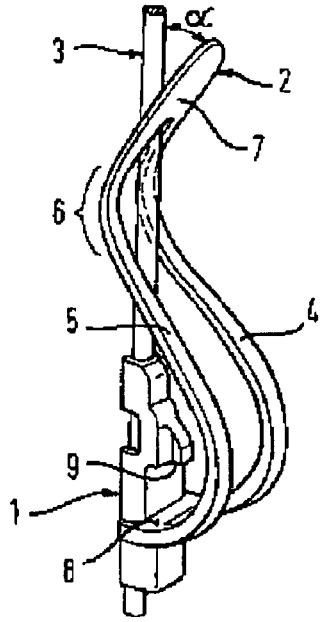
FIG. 1 is a perspective view of the fixing device according to the invention.

The preferred embodiment of the fixing device according to the invention as shown in FIG. 1 comprises a first section 1 embodied as a connecting region which is connected to a vertical basket element 3 by means of a snap connection not shown. Directly adjoining the first section 1 embodied as a connecting region is the second section 2 embodied as a retaining clip which winds vertically upwards in an S-shape.

The second region 2 embodied as a retaining clip consists of two arms 4, 5 which combine in one end region and form a tongue-like end region 7. An angle $\alpha$ is subtended between this tongue-like end region 7 and the vertical basket element 3 which serves as an insertion aid for the object to be fixed, for example a hollow vessel. When such a hollow vessel is inverted over the fixing device according to the invention, this spreads the fixing device according to the invention and the vertical basket element apart from one another.

As soon as an edge of a hollow vessel or another region of the object comes to rest on the shoulder 8, the second section 2 embodied as a retaining clip nestles against the object to be fixed, for example, a hollow vessel, along the contact zone 6 and presses this against the vertical basket element 3 as a result of the pre-tensioning force in the second section 2 embodied as a retaining clip. As a result of the plastic coating of the vertical basket element 3, an increased state of friction exists between the vertical basket element 3 and the vessel wall which provides for secure fixing in the crockery basket.

A retaining region 9 is arranged above the shoulder 8 of the first section 1 embodied as a connecting region, this retaining region being embodied as a projecting lug provided with a surface embodied as a sliding surface on its upper side and having a projecting overhang on its lower side. The retaining region 9 is used to securely fix vessels or containers having an edge and lighter weight, such as yoghurt pots for example, against a strong spray jet coming from below whilst the upper sloping sliding surface should facilitate insertion and lowering of the edge of a vessel as far as the shoulder 8.

Figure 2:
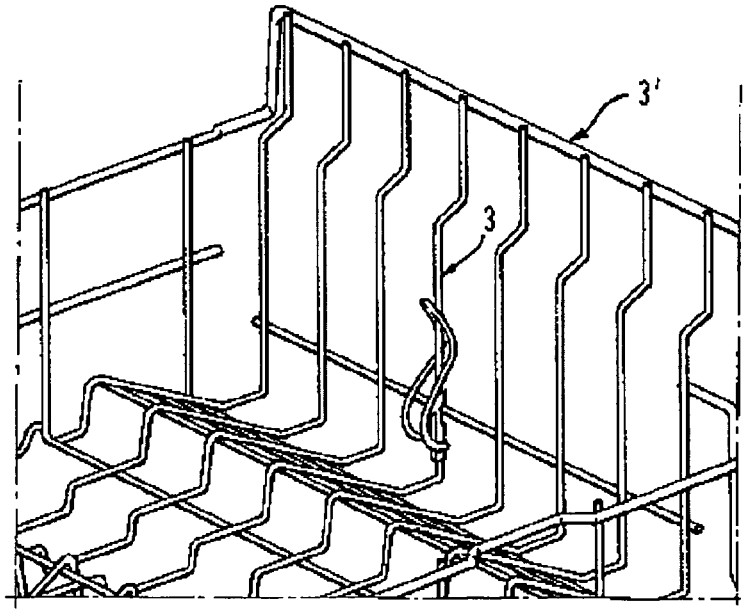
FIG. 2 shows the fixing device according to the invention in a commercially available crockery basket.

FIG. 2 shows the use of the fixing device according to the invention in a crockery basket 3' having a plurality of vertical basket elements 3.

REFERENCE LIST

1 First section embodied as connecting region
2 Second section embodied as retaining clip
3 Basket element
4 Arm
5 Arm
6 Contact area
7 End region

The invention claimed is:

1. A fixing device for fixing the location of an object in a dishwasher comprising:

a first section that can be coupled to a crockery basket of the dishwasher;

a second section extending substantially vertically forming a curve, the first section being substantially non-rotating and being capable of being coupled to a vertical element of the crockery basket, wherein the second section is a retaining clip interrupted along its vertical axis in such a manner that a vertical basket element can be guided through this interrupted section.

2. The fixing device for an object according to claim 1, wherein an end region of the second section is solid such that it is not interrupted along the vertical axis of the second section, the end region being located at an end of the second section opposite the first section.

3. A fixing device for fixing the location of an object in a dishwasher, comprising:

a first section that can be coupled to a crockery basket of the dishwasher; and a second section extending substantially vertically forming a curve, the first section being connectable to a cutlery basket of a dishwasher, wherein the second section is a retaining clip interrupted along its vertical axis in such a manner that a vertical basket element can be guided through this interrupted section, and an end region of the second section is solid such that it is not interrupted along the vertical axis of the second section, the end region being located at an end of the second section opposite the first section.

4. The fixing device according to claim 3, wherein the second section is a retaining clip that it can be deformed manually.

5. The fixing device according to claim 4, further comprising a retaining region protruding from the first section and located between the first section and the second section.

6. The fixing device according to claim 3, further comprising a retaining region protruding from the first section and located between the first section and the second section.

7. A fixing device for fixing the location of an object in a dishwasher, comprising:

a first section that can be coupled to a crockery basket of the dishwasher; and a second section extending substantially vertically forming a curve, the first section being non-detachably connectable to a region of the crockery basket, wherein the second section is a retaining clip interrupted along its vertical axis in such a manner that a vertical basket element can be guided through this interrupted section, and an end region of the second section is solid such that it is not interrupted along the vertical axis of the second section, the end region being located at an end of the second section opposite the first section.

8. The fixing device according to claim 2, wherein the second section is a retaining clip that it can be deformed manually.

9. The fixing device according to claim 8, further comprising a retaining region protruding from the first section and located between the first section and the second section.

10. The fixing device according to claim 7, further comprising a retaining region protruding from the first section and located between the first section and the second section.

11. A crockery basket for use in a dishwasher, comprising:

a plurality of vertical basket elements;

a fixing device for fixing the location of an object in the basket, the fixing device having a first section that is coupled to the basket; and a second section extending substantially vertically forming a curve, wherein the second section is a retaining clip interrupted along its vertical axis defining two arms, the arms being adapted to receive one of the vertical basket elements in between the two arms, and an end region of the second section is solid such that it is not interrupted along the vertical axis of the second section, the end region being located at an end of the second section opposite the first section and being attached to the two arms.

12. The basket according to claim 11, wherein the second section is a retaining clip that it can be deformed manually.

13. The basket according to claim 12, further comprising a retaining region protruding from the first section and located between the first section and the second section.

14. The basket according to claim 11, further comprising a retaining region protruding from the first section and located between the first section and the second section.

* * * * *

UNITED STATES PATENT AND TRADEMARK OFFICE

CERTIFICATE OF CORRECTION

PATENT NO. : 8,418,703 B2
APPLICATION NO. : 10/589053
DATED : April 16, 2013
INVENTOR(S) : Schessl et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 2011 days.

Signed and Sealed this
First Day of September, 2015

Michelle K. Lee

Michelle K. Lee
*Director of the United States Patent and Trademark Office*